United States Patent [19]

LeBegue

[11] 4,380,354

[45] Apr. 19, 1983

[54] MINING MACHINE LOADING BIN MOUNTED ON BOOM STRUCTURE AND METHOD

[75] Inventor: Maurice K. LeBegue, Argillite, Ky.

[73] Assignee: National Mine Service Company, Pittsburgh, Pa.

[21] Appl. No.: 242,832

[22] Filed: Mar. 12, 1981

[51] Int. Cl.[3] ..... E21C 27/24

[52] U.S. Cl. ..... 299/18; 299/67; 299/76

[58] Field of Search ..... 299/18, 64, 67, 75, 299/76

[56] References Cited

U.S. PATENT DOCUMENTS

| | | | |
|---|---|---|---|
| 3,109,636 | 11/1963 | Hlinsky | 299/76 X |
| 3,288,536 | 11/1966 | Galis et al. | 299/76 X |
| 3,774,969 | 11/1973 | LeBegue | 299/76 |
| 4,061,398 | 12/1977 | Parkes | 299/18 X |
| 4,062,595 | 12/1977 | Roepke et al. | 299/18 |
| 4,277,105 | 7/1981 | Taylor | 299/76 X |

*Primary Examiner*—Ernest R. Purser

*Attorney, Agent, or Firm*—Stanley J. Price, Jr.; John M. Adams

[57] ABSTRACT

A self-propelled mining machine includes a mobile body portion with a boom extending forwardly therefrom. The boom rotatably supports a rotatably driven cutter drum having peripherally extending cutting elements. The boom member includes a trough formed by inclined sidewalls. The inclined sidewalls are positioned in space relation and extend upwardly on opposite sides of the receiving end of a conveyor that extends continuously the length of the machine body portion. The sidewalls slope downwardly toward the lateral edges of the conveyor receiving end and form a material receiving bin or hopper. The receiving end of the conveyor forms the floor of the hopper. The front end of the hopper extends the length of the cutter drum. Suitable drive means rotate the cutter drum to dislodge material from a mine face and direct the dislodged material by rotation of the cutter drum over the cutter drum and rearwardly into the hopper. The dislodged material is directed down the inclined sidewalls of the hopper onto the receiving end of the conveyor. The conveyor transports the dislodged material rearwardly on the mining machine to a discharged end of the conveyor. The boom member together with the receiving end of the conveyor and the hopper are pivotally movable with the cutter drum member as the cutter drum is raised and lowered to form a shear cut in the mine face.

19 Claims, 5 Drawing Figures

MINING MACHINE LOADING BIN MOUNTED ON BOOM STRUCTURE AND METHOD

BACKGROUND OF THE INVENTION

1. Field of the Invention

This invention relates to a mining machine and a method of mining and more particularly to the boom structure of a mining machine that rotatably supports a cutter drum for rotation of the drum to convey dislodged material over the cutter drum and into a hopper portion of the boom where the hopper directs the dislodged material onto a conveyor that transports the dislodged material rearwardly on the mining machine.

2. Description of the Prior Art

A conventional drum-type continuous mining machine employed in underground mining operations includes a boom member that extends forwardly from the mining machine body portion. The boom member includes a pair of arm members that are mounted adjacent opposite sides of the longitudinal center line of the machine. By operation of hydraulically controlled piston cylinder assemblies, the boom arms are arranged to pivot upwardly and downwardly.

U.S. Pat. Nos. 3,712,678 and 3,774,969 illustrate examples of cutter drums that are rotatably mounted transversely on the front ends of the boom arms. An endless conveying chain extends longitudinally along the center line of the machine in a trough. The conveyor extends from a receiving end the length of the machine to a discharge end which includes a pivotal section that extends rearwardly from the mining machine.

The receiving end of the continuous conveyor is operatively associated with a gathering device. The conventional gathering device includes a gathering platform that extends transversely across the front of the mining machine and tapers rearwardly to the receiving end of the conveyor as disclosed in U.S. Pat. Nos. 2,703,244 and 3,328,087. The gathering arms, as illustrated in U.S. Pat. No. 3,328,087, are rotatably mounted adjacent the transverse forward edge of the gathering platform. The gathering arms rotate in opposite directions to convey the dislodged material rearwardly from the gathering platform onto the receiving end of the conveyor as the mining machine advances during the material dislodging operation.

In order to effectively convey the dislodged material from the gathering platform onto the receiving end of the conveyor a plurality of gathering arms must be spaced transversely across the width of a gathering platform on opposite sides of the receiving end of the conveyor. It is important that the gathering arms be positioned as closely as possible to the lateral edges of the gathering platform to convey the material deposited thereon onto the receiving end of the conveyor.

It is the conventional practice to drivingly connect the gathering arms so that the gathering arms or in the case of gathering discs rotate in a direction to convey the material inwardly from the platform lateral edges and rearwardly onto the receiving end of the conveyor. Generally the drive mechanisms for the gathering arms include one or more motors mounted on the gathering platform. Suitable drive gearing connects each motor to one of the gathering arms on each side of the conveyor. The other gathering arms on each side of the conveyor are drivingly connected thereto by additional gearing arrangements such as a drive shaft and a worm drive mechanism to transmit rotation from one gathering arm to the other gathering arm on each side of the conveyor. It is also known to drivingly connect one pair of gathering arms on one side of the conveyor to the pair of gathering arms on the other side of the conveyor.

The drive connections to the gathering arms and the means for rotatably supporting the gathering arms on the gathering platform are quite complex. Due to their complexity malfunctions commonly occur which require their repair in order to continue the continuous mining operation. Therefore, there is need to provide an improved material conveying device and method associated with a continuous mining machine that eliminates the complexity of the conventional motor driven gathering arms on a gathering platform.

SUMMARY OF THE INVENTION

In accordance with the present invention, there is provided a mining machine that includes a mobile body portion. A boom member is pivotally secured to the body portion and extends forwardly therefrom. A drum member is rotatably mounted on the front of the boom member transversely to the body portion. Cutting elements extend from the drum member. A continuous conveyor extends substantially the length of the body portion. The continuous conveyor has a front end portion supported by the boom member for pivotal movement therewith. The conveyor front end portion extends closely adjacent to the cutter drum member. Drive means rotate the drum member in a direction to dislodge material from a mine face and direct the dislodged material by rotation of the drum member over the drum member and rearwardly onto the conveyor front end portion.

Further in accordance with the present invention there is provided a mining machine that includes a mobile body portion and a boom member pivotally secured to the body portion and extending forwardly therefrom. A material dislodging device is mounted on the front of the boom member. Cutting elements extend from the material dislodging device. The boom member includes a trough portion positioned rearwardly of the material dislodging device. The trough portion has a material receiving end extending the length of the material dislodging device. A continuous conveyor extends substantially the length of the mobile body portion. The continuous conveyor has a receiving end portion positioned in the trough portion and a discharge end portion. The conveyor receiving end portion extends closely adjacent to the material dislodging device to receive material dislodged by the dislodging device and deposited into the trough portion material receiving end. The continuous conveyor is operable to convey the dislodged material rearwardly through the trough portion to the discharge end portion.

Preferably the trough portion includes a pair of inclined sidewalls that are secured to opposite sides of the body portion of the boom and are positioned in spaced relation so that the front of the trough extends the length of the drum member. With this arrangement the conveyor front end portion and the inclined sidewalls form a material receiving bin or hopper where the conveyor front end portion forms the floor of the hopper. The conveyor front end portion is positioned closely adjacent to the drum member to receive the mine material that is dislodged by rotation of the drum member to convey the material rearwardly over the drum member and into the hopper. The inclined sidewalls of the hopper direct the dislodged material downwardly onto the conveyor front end portion.

Suitable drive means mounted on the boom laterally of the material receiving hopper transmit drive to the drum member for rotation of the drum member in a counterclockwise direction so that the drum member cuts upwardly from the bottom. By rotation of the drum member in this preselected direction the dislodged material is carried over the drum member and deposited into the hopper. The slope of the inclined sidewalls is selected so that the dislodged material is efficiently conveyed downwardly and directed onto the surface of the conveyor front end. The conveyor transports the dislodged material rearwardly on the mining machine to a pivotal discharge end portion of the conveyor. From the pivotal discharge end portion, the dislodged mine material is transferred into a suitable material haulage vehicle or onto another conveying device for movement of the mined material out of the mine.

The conveyor front end extends from a position closely adjacent the drum member rearwardly through the hopper. The remaining portion of the continuous conveyor extends from the front end to the pivotal discharge end. The material receiving bin or hopper is carried by the boom and therefore is raised and lowered with the boom as the drum member executes a shear cut in the mine face. Upward and downward movement of the drum member through an arcuate path forms shear cuts in the mine face. As the mine material is dislodged it is deposited into the hopper and deflected onto the conveyor front end which pivots with the boom as the boom raises and lowers the drum member.

A gathering device is secured to the front transverse edge of the hopper and serves to confine dislodged material deposited on the mine floor forward of the front edge of the hopper in the rotating path of the drum member. Preferably the gathering device includes a vertically movable bulldozer-type blade attached to the transverse front edge of the hopper at a position closely adjacent the mine floor and rearwardly of the drum member. The bulldozer-type blade is mounted to move freely on the mine floor closely adjacent the periphery of the drum member at the lower transverse forward edge of the hopper. With this arrangement any dislodged mined material not deposited in the hopper and deposited on the mine floor is confined forward of the blade and in the rotating path of the drum member. This permits the material on the mine floor to be picked up by the rotary drum when positioned at the mine floor.

Further in accordance with the present invention there is provided a method of dislodging solid material from a mine face that includes the steps of rotatably supporting a material dislodging device at the front end of a mining machine. The material dislodging device is positioned opposite a mine face. The material dislodging device is sumped into contact with the mine face. The material dislodging device is pivoted through the arcuate path between the mine roof and the mine floor to dislodge solid material from the mine face. The material dislodging device is rotated in a direction to convey the dislodged material over the material dislodging device and rearwardly thereof. The dislodged material is fed onto a conveyor positioned rearwardly of the material dislodging device. The dislodged material is transported rearwardly from the material dislodging device on the mining machine.

Accordingly, the principal object of the present invention is to provide a mining machine that includes a boom structure that supports a longitudinally extending conveyor and includes a trough formed by oppositely positioned inclined sidewalls that extend upwardly from a conveyor front end and spaced the length of the drum member so as to receive dislodged material conveyed over the drum member and to direct the dislodged material onto the conveyor front end for conveyance rearwardly on the mining machine.

Another object of the present invention is to provide a hopper-type boom on a mining machine that rotatably supports a rotatable cutter drum where the hopper-type boom carries a conveyor for upward and downward movement with the boom as the cutter drum dislodges mine material from a mine face and the dislodged material is directed over the top of the cutter drum and into the hopper and onto the conveyor.

An additional object of the present invention is to provide a mining machine that includes a drum member rotatably mounted on the front of the boom member and rotated to direct the dislodged material over the top of the drum member and rearwardly onto a conveyor supported by the boom member.

A further object of the present invention is to provide a method of dislodging solid material from a mine face by rotatably supporting a cutter drum for rotation in a direction to dislodge mine material from a mine face and direct the dislodged material over the top of the cutter drum into a trough positioned on the boom member with a conveyor forming the floor of the trough so that the material is conveyed rearwardly on the boom member.

These and other objects of the present invention will be more completely disclosed and described in the following specification, accompanying drawings, and the appended claims.

DESCRIPTION OF THE PREFERRED EMBODIMENT

Figure 1:
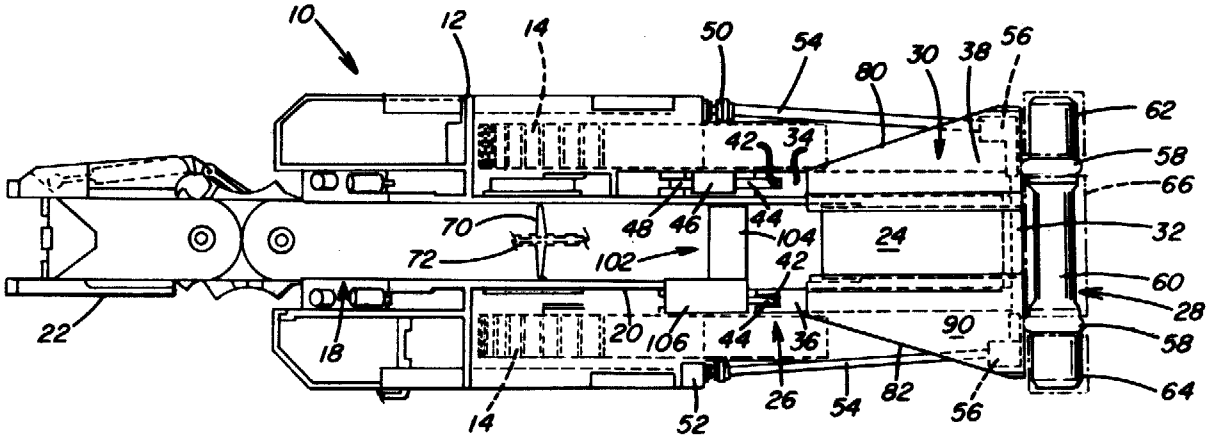
FIG. 1 is a top plan view of a continuous mining machine, illustrating a boom for rotatably supporting a cutter drum and including a hopper with a conveyor for receiving the material dislodged by the cutter drum.

Referring to the drawings and particularly to FIGS. 1-4, there is illustrated a continuous mining machine generally designated by the numeral 10 that has a body or frame portion 12 mounted on endless crawler tracks 14. Suitable drive motors 16 are provided to propel the mining machine 10 on the endless crawler tracks 14 to advance the mining machine during the mining operation. An endless conveyor mechanism 18 is positioned in a conveyor frame 20 positioned on the mining machine. The endless conveyor extends substantially the length of the mining machine 10 to convey dislodged material from the front of the mining machine to a pivotal discharge end 22 of the conveyor 18.

The endless conveyor 18 includes a front end portion 24 that is supported by a pivotal boom member generally designated by the numeral 26. The boom member 26 is pivotally secured to the body portion 12 and extends forwardly therefrom. A dislodging means such as a cutter drum member generally designated by the numeral 28 is rotatably mounted on the front of the boom member 26 transversely to the body portion 12. The boom member 26 includes a trough portion generally designated by the numeral 30. The trough portion 30 is integral with the boom member 26 and is positioned rearwardly of the drum member 28. The trough portion 30 has a material receiving end portion 32 that extends the length of the drum member 28.

The front end portion 24 of the endless conveyor 18 is positioned in the trough portion 30 and extends closely adjacent to the drum member 28. Material dislodged by the drum member 28 from a mine face is deposited into the trough portion material receiving end portion 32 as the drum member 28 rotates in a direction to convey the dislodge material by rotation of the drum member 28 over the drum member and rearwardly onto the conveyor front end portion 24. The conveyor front end portion 24 then transports the dislodged material rearwardly through the portion 30 and onto the remaining portions of the endless conveyor 18 to the pivotal discharge end portion 22. From the pivotal discharge end portion 22, the dislodged material is transferred to a suitable material haulage vehicle or onto another conveyor for transportion of the dislodged material out of the mine.

The forwardly extending boom member 26 has a pair of parallel arm members 34 and 36. The boom arm members 34 and 36 are connected to each other adjacent a front end portion 38 of the boom member 26 by a transverse housing 40, as illustrated in greater detail in FIG. 3. The boom arm members 34 and 36 are pivotally connected to the mine machine body portion 12 and are also pivotally connected at 42 to piston rods 44 of piston cylinder assemblies 46. The pair of piston cylinder assemblies 46 are, in turn, pivotally connected to the mine machine body portion 12 at 48.

Figure 2:
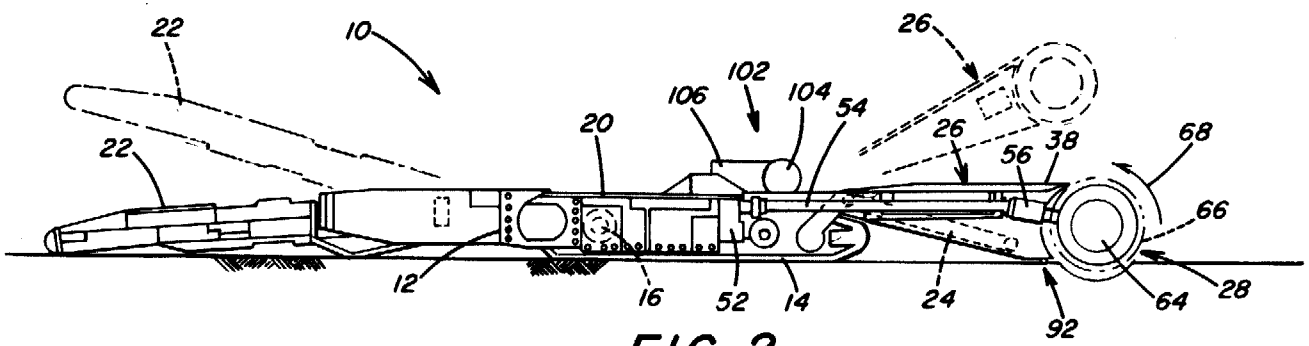
FIG. 2 is a view in the side elevation of the mining machine shown in FIG. 1, illustrating the hopper-type boom movable with the cutter drum for upward and downward pivotal movement on the front of the mining machine.

With this arrangement extension and retraction of the piston rods 44 within the piston cylinder assemblies 46 pivot the boom member 26 about the rear end portions of the boom arm members 34 and 36 to move the boom member 26 vertically to the position illustrated in phantom in FIG. 2 for an upward sheer cut by the cutter drum member 28. Drum rotating motors 50 and 52 are drivingly connected to the cutter drum member 28 to rotate the drum member 28 preferably in a counterclockwise direction, as viewed from the end of the drum member 28 illustrated in FIG. 4. With this arrangement the drum member 28 cuts upwardly from the bottom or mine floor to dislodge material from the mine face. The dislodged material is directed by rotation of the drum member 28 over the top of the drum member 28 and rearwardly into the trough portion 30 of the boom member 26 and onto the conveyor front end portion 24.

The motors 50 and 52 may be either electrical or hydraulic motors that are secured to the mining machine body portion 12 or to the boom member 26. In one embodiment as illustrated in FIGS. 1 and 2 the drum rotating motors 50 and 52 are positioned on the machine body portion 12. As illustrated in FIGS. 1–4, a drive shaft 54 extends from each of the drive motors 50 and 52 to a clutch mechanism generally designated by the numeral 56. The clutch mechanisms 56 are nonrotatably connected to drive means positioned within annular housing portions 58. The annular housing portions 58 are connected to the boom arm members 34 and 36 and therefore form part of the boom member 26.

The drive means from the clutch mechanism 56 extend through the annular housing portions 58 and are connected to the gearing within the drum member 28. The drive gearing for the drum member 28 is operable to rotate the drum member 28 to dislodge material from the mine face. With this arrangement cutter drum member 28 is rotatably supported by the annular housing portions 58.

The drum member 28 includes an intermediate portion 60 and a pair of end portions 62 and 64. The end portions 62 and 64 are rotatably supported by the housing portions 58 as is the intermediate portion 60. Suitable cutting elements extend from the periphery of the intermediate portion 60 and the end portion 62 and 64. In one embodiment the drum member 28 is the type that has a straight cutter head design with a cutting or bit pattern indicated by the dashed line 66 in FIGS. 1 and 2. The cutting bits are positioned on the intermediate portion 60 and the end portions 62 and 64 and are positioned adjacent the annular housing portions 58 between the intermediate portion 60 and the respective end portions 62 and 64. The bit pattern of the bits on the intermediate portion 60 is the same diameter as the bit pattern of the bits on the drum end portions 62 and 64. With this arrangement the bit patterns do not overlap but it should be understood that a drum member 28 having overlapping bit patterns can also be used.

The drum member 28 is arranged to dislodge material from a mine face rotation of the drum member 28 as it is sumped into the mine face. Preferably, in accordance with the present invention, the drum member intermediate portion 60 and end portions 62 and 64 are rotated in a counterclockwise directions as indicated by the arrow 68 in FIGS. 2 and 4 to cut upwardly in comparison with conventionally known cutter drums which rotate to cut downwardly. The dislodged material is conveyed over the top of the cutter drum 28 and into the trough portion 30 of the boom 26. This cutting arrangement forms a relatively horizontal linear floor and roof at the mine face as material is being dislodged.

Figure 3:
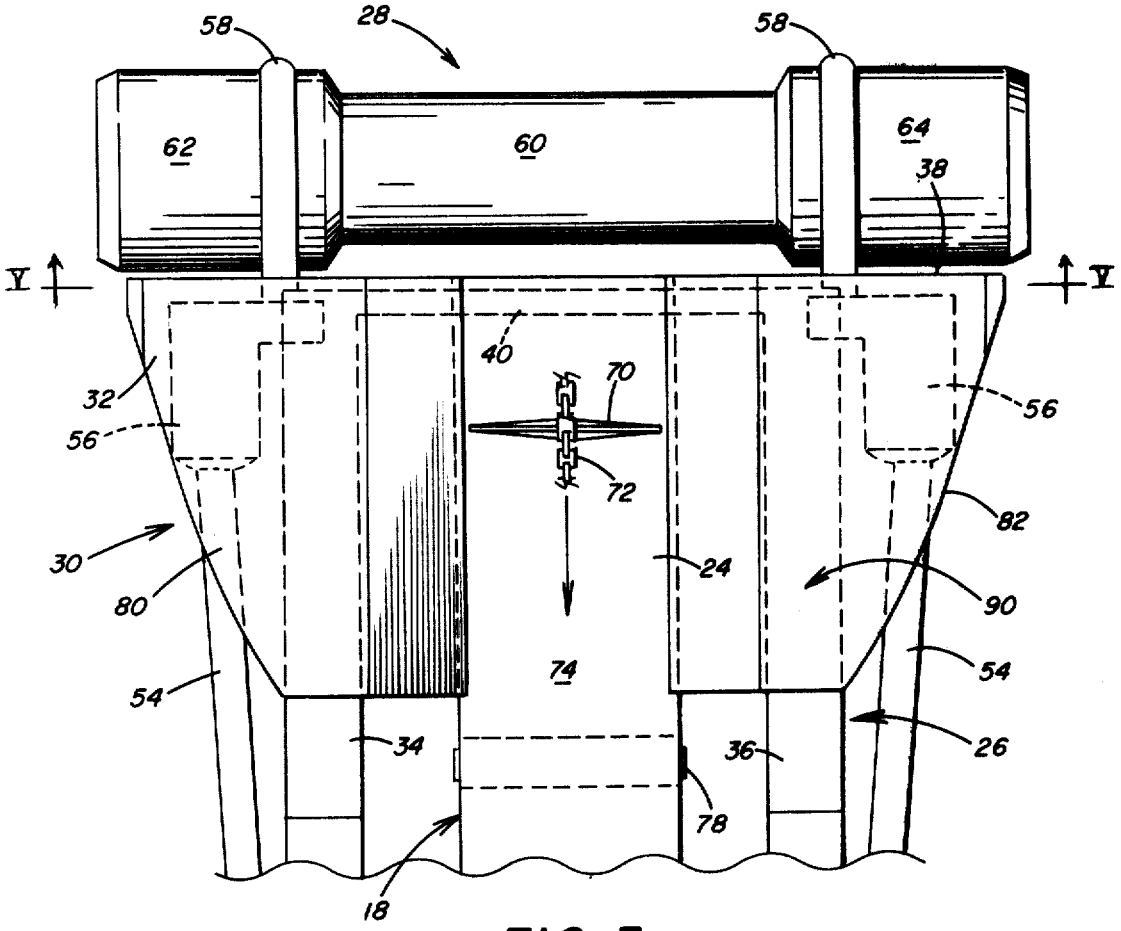
FIG. 3 is an enlarged fragmentary top plan view of the hopper-type boom, illustrating a continuous conveyor carried by the boom and positioned between a pair of inclined sidewalls for directing material dislodged by the cutter drum onto the conveyor positioned on the boom.
Figure 4:
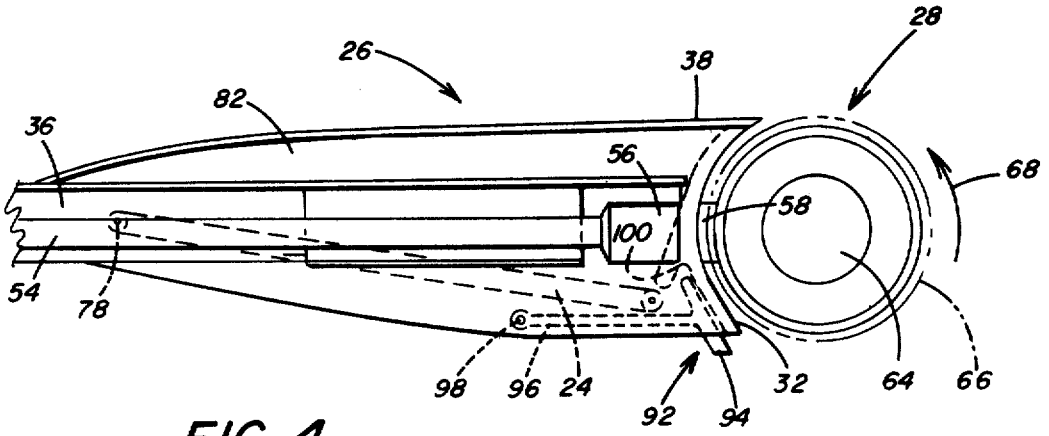
FIG. 4 is an enlarged fragmentary view in side elevation of the hopper-type boom of the present invention, illustrating a movable blade positioned at the front transverse edge of the boom for confining dislodged material on the mine floor forward of the boom.

Now referring to FIGS. 3 and 4 there is illustrated in greater detail the boom member 26 and the trough portion 30 for receiving the mined material dislodged by the cutter drum 28 and deposited into the trough receiving end 32 upon rotation of the drum member 28 in a preselected direction. As illustrated in FIG. 3 the material receiving end 32 of the trough portion 30 extends the length of the drum member 28. The conveyor front end portion 24 is positioned in the trough portion 30 and receives the dislodged material deposited into the trough portion 30 by rotation of the drum member 28. The conveyor front end portion 24 conveys the dislodged material from the trough portion 30 rearwardly onto the remaining portions of the conveyor 18 that extends the length of the mobile body portion 12.

Preferably the endless conveyor 18 which includes the conveyor front end portion 24 illustrated in FIGS. 3 and 4 and the pivotal discharge end portion 22 illustrated in FIGS. 1 and 2 is a flight-type conveyor that includes a plurality of parallel spaced flights 70 (only one of which is shown in FIG. 3) that are secured to an endless chain 72. The chain 72 is rotatably supported at its end portions by suitable sprockets and may be driven from either the front end 24 of the conveyor 18 adjacent the drum member 28 or at the pivotal discharge end 22 of the conveyor 18.

Figure 5:
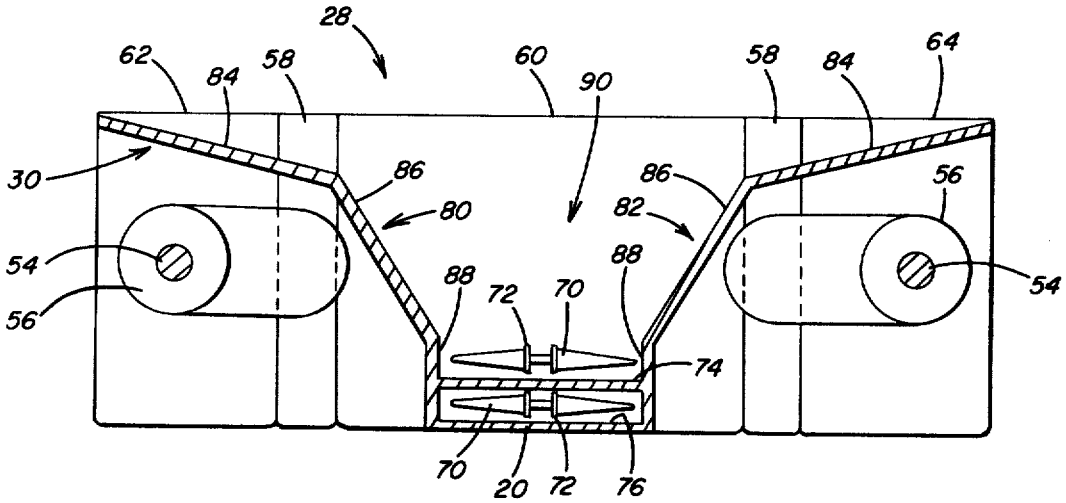
FIG. 5 is a fragmentary sectional view of the hopper-type boom taken along line V—V of FIG. 4, illustrating the inclined sidewalls of the boom hopper and the drive connections to the cutter drum.

The chain 72 is movable on the conveyor frame 20 which includes conveyor surfaces 74 and 76 shown in FIG. 5 that are positioned in spaced overlying relation. The chain 72 includes, as further illustrated in FIG. 5, an upper reach supported by the conveyor frame surface 74 and a lower reach supported by the conveyor frame surface 76. With this arrangement the conveyor chain 72 is rotated to advance the flights 70 on the conveyor frame surfaces 74 and 76. As the flights 70 advance from the conveyor front end portion 24 to the conveyor pivotal discharge end portion 22, the dislodged material deposited on the conveyor frame surface 74 is moved by the advancing flights rearwardly from the drum member 28 on the mining machine body portion 12.

While the endless conveyor 18 formed by the chain 72 is a continuous conveyor from the front end portion 24 to the discharge end portion 22, the front end portion 24 is pivotal about a pivot connection 78 shown in FIGS. 3 and 4. This arrangement per mits the conveyor front end portion 24 to pivot with the boom member 26 as the boom member 26 raises and lowers the drum member 28 to make a shear cut in the mine face. Similarly as illustrated by the phantom lines in FIG. 2 the conveyor discharge end portion 22 is pivotal about a horizontal axis relative to the remaining portions of the conveyor 18 to position the discharge end portion 22 at a preselected height for discharging the material into a haulage vehicle or onto another conveying device.

The trough portion 30 of the boom member 26 is formed by a pair of inclined sidewalls generally designated in FIG. 5 by the numerals 80 and 82 that are secured to the boom arm members 34 and 36 respectively. Each of the sidewalls 80 and 82 is formed by a plurality of connected plate members 84, 86, and 88. The plate members 84 extend from the outer lateral edges of the drum end portions 62 and 64 and are sloped at a first angle with respect to the plate member 86. Each plate member 86 is sloped at a second angle with respect to the respective plate member 84 and is suitably connected at its upper end to plate member 84 and its lower end to the plate member 88. The slope of the plate member 86 is greater than the slope of the plate member 84 so as to direct or convey the dislodged material deposited into the material receiving end 32 from the plate members 84 to the plate members 86.

The plate members 88 are vertically positioned and formed integral with the conveyor support frame 20. As illustrated in FIG. 5, the plate members 88 are positioned abutting the lateral edges of the conveyor frame surfaces 74 and 76. With this arrangement the dislodged material is directed downwardly by the sloping surfaces of the plates 84 and 86 onto the conveyor frame surface 74. From the conveyor frame surface 74 the material is moved rearwardly by the upper reach of the endless conveyor 18. Also provision can be made to vibrate the plate members 84, 86, and 88 by suitable means to facilitate feeding the material into the conveyor front end 24.

The conveyor front end portion 24 and the trough inclined sidewalls 80 and 82 form a material receiving bin or hopper generally designated by the numeral 90 in FIGS. 3 and 5. The conveyor front end portion 24 forms the floor of the hopper 90. With this arrangement all the material that is deposited into the hopper 90 is collected by the conveyor front end portion 24 and is conveyed rearwardly on the mining machine body portion 12 to the pivotal discharge end portion 22. The slope of the hopper inclined sidewalls 80 and 82 is determined by the relative angular position of the plate members 84, 86, and 88 to assure that all the material dislodged by the drum member 28 and conveyed rearwardly over the top of the drum member 28 into the hopper 90 is deposited onto the conveyor front end portion 24.

The material receiving bin or hopper 90 is carried by the boom member 26. Therefore, as the boom member 26 is raised and lowered to execute a shear cut in the mine face by rotation of the drum member 28, the material receiving bin 90 and the conveyor front end portion 24 move with the boom member 26 and the drum member 28. Thus as the boom member 26 is being raised and the drum member 28 cuts upwardly from the mine floor toward the mine roof, the bin 90 and the conveyor front end portion 24 also move upwardly. As the boom member 26 is pivoted upwardly through an arcuate path and the drum member 28 shears material from the mine face, the dislodged material is caught by the upwardly moving bin or hopper 90 and confined therein and directed into the conveyor front end portion 24. This prevents the dislodged material from being deposited on the mine floor and assures that substantially all the material that is dislodged from the mine face by the drum member 28 is directed into the hopper 90 and onto the conveyor front end portion 24.

To facilitate the confinement of the dislodged material forwardly of the material receiving bin 90, a movable or floating bulldozer-type blade member generally designated by the numeral 92 in FIG. 4 extends between the trough sidewalls 80 and 82 closely adjacent to the drum member 28. The blade 92 functions in a bulldozing-type fashion across the front of the material receiving bin 90. The blade 92 includes a deflector portion 94 that extends transversely across the lower edge of the material receiving bin 90 and is inclined at an angle rearwardly from the drum member 28. A pair of arm members 96 (only one of which is shown in FIG. 4) extends rearwardly from the deflector portion 94 for pivotal connection at 98 to the sidewalls 80 and 82.

Preferably the arm members 96 are suitably mounted for limited pivotal movement upwardly and downwardly about the connection point 98. With this arrangement the deflector portion 94 floats or follows the contour of the mine floor as the drum member 28 cuts at the mine floor or at an elevation slightly above the mine floor. In this position of the drum member 28, the deflector portion 94 remains in contact with the mine floor. Above this position of the drum member 28, the deflector portion 94 moves upwardly with the boom member 26 as an upward shear cut is made in the mine face.

Further as illustrated in FIG. 4 to accommodate the floating movement of the blade 92 on the mine floor, the upper edge of the deflector portion 94 is movable in lateral recesses 100 provided in the trough sidewalls 80 and 82. The deflector portion 94 moves upwardly into the lateral recesses 100 to allow the drum member 28 to cut below grade as the boom member 26 moves in a downward or descending path.

When the drum member 28 is initially positioned on the mine floor opposite the mine face for forming an upward shear cut in the mine face, the deflector portion 94 of the blade 92 is in contact with the mine floor. As the boom member 26 is pivoted upwardly to carry with it the drum member 28, mine material is dislodged by the drum member 28 and conveyed over the top of the drum member 28 in the direction of the arrow 68 illustrated in FIG. 4. The blade 92 moves upwardly with the boom member 26 when the drum member 28 is raised.

When the drum member 28 is positioned at or adjacent the mine floor, the deflector portion 94 functions as a bulldozer blade to prevent the dislodged material from passing rearwardly behind the blade 92. In this manner, the loose material on the mine floor is maintained in the circulating path of the drum member 28 forward of the deflector portion 94 when the drum member 28 is lowered. Thus the loose material is maintained in contact with the flow of material generated by rotation of the drum member 28 when positioned at the mine floor. When the drum member 28 is in this position, the dislodged material positioned on the mine floor and forward of the blade 92 is picked up in the flow generated by the rotating drum 28. The loose material is carried over the drum member 28 and into the material receiving bin 90. Thus the dislodged material not deposited in the hopper 90 and deposited on the mine floor is confined forward of the blade 92 for pickup by the rotating drum member 28.

Further in accordance with the present inventon as illustrated in FIGS. 1 and 2 there is illustrated a material breaker device generally designated by the numeral 102. The material breaker device 102 is positioned on the machine body portion 12 in overlying relation with the endless conveyor 18. The breaker device 102 is operable to shatter the larger chunks of material dislodged by the upward shearing action of the drum member 28 into smaller chunks. Preferably the material breaker device 102 includes a cylindrical cutter drum 104 having a plurality of cutter bits (not shown) positioned on the periphery thereof. The cutter drum 104 is rotatably driven by a suitable motor 106. The drum 104 is rotatably supported at its end portions on the mining machine 10 by conventional bearings.

The cutter drum 104 is operable by the action of the cutter bits to engage the larger chunks between the cutter drum and the conveyor 18. The drum 104 rotates as the dislodged material passes beneath the drum 104 on the conveyor 18. The shattered material passes with the remaining dislodged material on the conveyor 18 rearwardly on the machine body portion 12 to the pivotal discharge end portion 22 of the conveyor 18.

According to the provisions of the patent statutes, I have explained the principle, preferred construction, and mode of operation of my invention and have illustrated and described what I now consider to represents its best embodiments. However, it should be understood that within the scope of the appended claims, the invention may be practiced otherwise than as specifically illustrated and described.

I claim:

1. A mining machine comprising, a mobile body portion, a boom member pivotally secured to said body portion and extending forwardly therefrom, a drum member rotatably mounted on the front of said boom member transversely to said mobile body portion, cutting elements extending from said drum member, a continuous conveyor extending substantially the length of said body portion, said continuous conveyor having a front end portion supported by said boom member for pivotal movement therewith, said conveyor front end portion extending closely adjacent to said drum member, said boom member including a material receiving hopper formed by a pair of inclined sidewalls extending upwardly from the opposite sides of said conveyor front end portion, said conveyor front end portion forming a floor of said hopper, said material receiving hopper and said conveyor front end portion being pivotally movable with said boom member as a single unit, said material receiving hopper having a receiving end extending the length of said drum member, drive means for rotating said drum member in a direction to dislodge material from a mine face and direct the dislodged material by rotation of said drum member over said drum member and rearwardly into said receiving end of said material receiving hopper, and said inclined sidewalls operable to direct the dislodged material by gravity flow downwardly into said hopper to feed said material onto said conveyor front end portion for rearward conveyance on said body portion.

2. A mining machine as set forth in claim 1 in which, said boom member with said material receiving hopper and said conveyor front end portion forming a trough portion extending rearwardly of said drum member, said trough portion having a material receiving end extending the length of said drum member, and said conveyor front end portion positioned in said trough portion to receive the dislodged material and convey the dislodged material rearwardly on said boom member.

3. A mining machine as set forth in claim 1 in which, said material receiving hopper is pivotal with said drum member as said boom member is pivoted to make a shear cut in the mine face by said drum member.

4. A mining machine as set forth in claim 1 in which, said drum member is operable to rotate in a preselected direction to dislodge material from a mine face and direct the dislodged material over said drum member into said hopper for gravity feeding said conveyor front end portion.

5. A mining machine as set forth in claim 1 in which, said conveyor includes a discharge end portion extending rearwardly from said mobile body portion, said conveyor being continuous in length from said front end portion to said discharge end portion, and said front end portion being vertically pivotal relative to said discharge end portion with said boom member as said drum member is raised and lowered.

6. A mining machine as set forth in claim 1 which includes, means for confining dislodged material deposited on the mine floor forwardly of said conveyor front end portion, said means for confining dislodged material extending transversely relative to said conveyor front end portion and positioned rearwardly of said drum member, and said means for confining dislodged material being connected to said boom member to remain in contact with the mine floor and follow the contour of the mine floor as the mining machine moves in a mine.

7. A mining machine as set forth in claim 1 which includes, material breaker means positioned on said mobile body portion and associated with said continuous conveyor for breaking up the dislodged material conveyed rearwardly on said mobile body portion.

8. A mining machine comprising, a mobile body portion, a boom member pivotally secured to said body portion and extending forwardly therefrom, a material dislodging device mounted on the front of said boom member, cutting elements extending from said material dislodging device, said boom member including a trough portion extending rearwardly of said material dislodging device, said trough portion and said material dislodging device being carried by said boom member as a single unit, said trough portion having a material receiving end extending the length of said material dislodging device, a continuous conveyor extending substantially the length of said mobile body portion, said continuous conveyor having a receiving end portion and a discharge end portion, said conveyor receiving end portion being positioned in said trough portion and extending closely adjacent to said material dislodging device, said conveyor receiving end portion forming a floor of said trough adapted to receive mined material dislodged by said material dislodging device and deposited over said material dislodging device and downwardly by gravity into said trough portion material receiving end, and said conveyor receiving end portion being operable to convey the dislodged material rearwardly through said trough portion to said discharge end portion.

9. A mining machine as set forth in claim 8 in which, said trough portion has a material receiving end extending the length of the width of said material dislodging device, and said conveyor receiving end portion forming said floor of said trough portion being pivotal with said material dislodging device to receive the dislodged material and convey the dislodged material in said trough portion rearwardly on said boom member as said material dislodging device is pivoted.

10. A mining machine as set forth in claim 8 in which, said trough portion includes a pair of sidewalls extending upwardly from the opposite sides of said conveyor receiving end portion, said sidewalls forming with said conveyor receiving end portion a material receiving bin, and said material receiving bin being adapted to receive dislodged material conveyed over said material dislodging device and to direct the dislodged material down said inclined sidewalls onto said conveyor receiving end portion.

11. A mining machine as set forth in claim 10 in which, said material receiving bin is pivotal with said material dislodging device as said boom member is pivoted to make a shear cut in the mine face by said material dislodging device.

12. A mining machine as set forth in claim 8 in which, said material dislodging device includes a cutter drum member operable to rotate in a preselected direction and dislodge material from a mine face in a direction upwardly from the mine floor and over said drum member into said trough.

13. A mining machine as set forth in claim 8 in which, said conveyor receiving end portion is vertically pivotal relative to said discharge end portion with said boom member as said material dislodging device is raised and lowered.

14. A mining machine as set forth in claim 8 which includes, means for confining dislodged material deposited on the mine floor forwardly of said conveyer receiving end portion, said means for confining dislodged material extending transversely relative to said conveyor receiving end portion and positioned rearwardly of said material dislodging device, and said means for confining dislodged material being connected to said boom member to remain in contact with the mine floor and follow the contour of the mine floor as the mining machine moves in a mine.

15. A mining machine as set forth in claim 8 which includes, material breaker means positioned on said mobile body portion and associated with said continuous conveyor for breaking up the dislodged material conveyed rearwardly on said mobile body portion.

16. A method of dislodging solid material from a mine face comprising the steps of, rotatably supporting a material dislodging device on a boom member at the front end of a mining machine, positioning the material dislodging device opposite a mine face, sumping the material dislodging device into contact with the mine face, pivoting the boom member to move the material dislodging device through an arcuate path between the mine roof and floor to dislodge solid material from the mine face, carrying a material receiving bin on the boom member rearwardly of the material dislodging device for movement with the material dislodging device as a single unit, rotating the material dislodging device in a direction to convey the dislodged material over the material dislodging device and rearwardly into the material receiving bin, feeding the dislodged material rearwardly through the material receiving bin and onto a conveyor extending rearwardly of the material dislodging device, and transporting the dislodged material on the conveyor rearwardly on the mining machine.

17. A method of dislodging solid material from a mine face as set forth in claim 16 which includes, depositing the dislodged material by gravity flow into the material receiving bin rearwardly of the material dislodging device, and feeding the dislodged material out of the material receiving bin onto the conveyor.

18. A method of dislodging solid material from a mine face as set forth in claim 16 which includes, positioning a conveyor in the material receiving bin on the boom member to extend rearwardly from the material dislodging device, pivoting the boom member upwardly from the mine floor so that the material dislodging device dislodges material from the mine face as the boom member pivots upwardly from the mine floor, directing the dislodged material upwardly and over the material dislodging device, and feeding the dislodged material by gravity downwardly into a trough conveyor of the material receiving bin having sidewalls for directing the dislodged material onto the conveyor. trough conveyor for rearward movement onto the

19. A method of dislodging solid material from a mine face as set forth in claim 16 which includes, confining portions of the dislodged material not fed into the material receiving bin forward of the material dislodging device on the mine floor and in the rotating path of the material dislodging device for pick up and conveyance over the material dislodging device into the material receiving bin.

* * * * *